US006789743B2

(12) United States Patent
Baranowski et al.

(10) Patent No.: US 6,789,743 B2
(45) Date of Patent: Sep. 14, 2004

(54) INJECTION VALVE HAVING A BYPASS THROTTLE

(75) Inventors: Dirk Baranowski, Regensburg (DE); Wendelin Klügl, Seubersdorf (DE); Gerd Schmutzler, Kareth (DE); Joachim Wagner, Dietfurt A.D. Altmuehl (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/259,148

(22) Filed: Sep. 27, 2002

(65) Prior Publication Data

US 2003/0025005 A1 Feb. 6, 2003

Related U.S. Application Data

(63) Continuation of application No. PCT/DE01/00893, filed on Mar. 8, 2001.

(30) Foreign Application Priority Data

Mar. 28, 2000 (DE) ..... 100 15 268

(51) Int. Cl.[7] ..... B05B 9/00

(52) U.S. Cl. ..... 239/124; 239/88; 239/533.2; 239/585.1; 239/102.1; 239/95

(58) Field of Search ..... 239/88, 89, 90, 239/91, 92, 93, 94, 95, 124, 533.2, 583, 584, 585.1, 102.1

(56) References Cited

U.S. PATENT DOCUMENTS 3,680,782 A 8/1972 Monpetit et al. ..... 239/96
5,542,610 A * 8/1996 Augustin ..... 239/533.8
5,890,653 A * 4/1999 Kelly ..... 239/5

FOREIGN PATENT DOCUMENTS

| | | | | |
|---|---|---|---|---|
| DE | 196 24 001 A1 | | 12/1997 | F02M/63/00 |
| DE | 19741850 A1 | * | 3/1999 | F02M/45/04 |
| DE | 198 26 791 A1 | | 12/1999 | F02M/45/02 |
| DE | 198 37 890 A1 | | 2/2000 | F02M/47/02 |
| DE | 100 15 268 A1 | | 10/2001 | F02M/47/02 |
| EP | 0 603 616 A1 | | 12/1993 | F02M/47/02 |
| EP | 0 798 459 A2 | | 10/1997 | F02M/47/02 |
| EP | 0 921 301 A2 | | 6/1999 | F02M/47/02 |
| EP | 0 976 924 A2 | | 2/2000 | F02M/47/02 |
| WO | WO 01/73287 A1 | | 10/2001 | F02M/47/02 |

OTHER PUBLICATIONS

A Common Rail Injection System for High Speed Direct Injection Diesel Engines, SAE Paper 980 803, von N. Guerrassi et al. Copyright 1998 Society of Automotive Engineers, Inc.

* cited by examiner

*Primary Examiner*—Robin O. Evans
(74) *Attorney, Agent, or Firm*—Baker Botts L.L.P.

(57) ABSTRACT

The invention relates to an injection valve, comprising a control chamber (15) with a control piston (16) that is functionally linked with a nozzle needle (35). The control chamber (15) is linked, via an inlet throttle (13), with pressurized fuel, and with an outlet throttle (14) with a valve chamber (9). A servo valve (5) is disposed in the valve chamber (9), said servo valve opening a connection between the valve chamber (9) and a return element (40) depending on its position. The inventive injection valve further comprises a bypass throttle (12) that is interposed between the fuel feed line and the valve chamber.

8 Claims, 1 Drawing Sheet

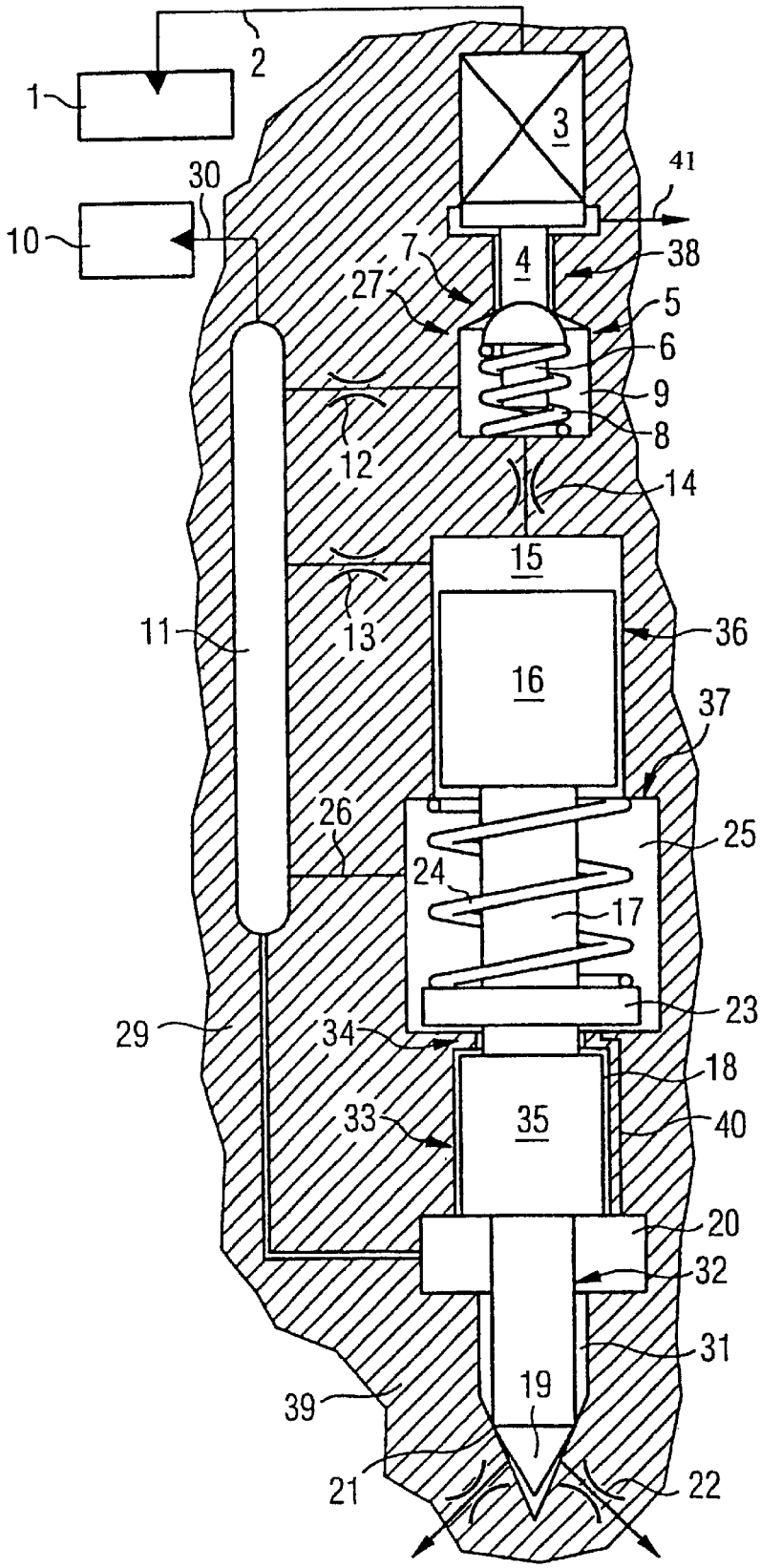
1
2
3
41
30
10
7
4
38
27
5
6
9
8
12
14
15
11
13
36
16
37
26
25
24
17
23
29
34
18
33
35
40
20
32
31
19
39
21
22

INJECTION VALVE HAVING A BYPASS THROTTLE

CROSS REFERENCE TO RELATED APPLICATION

This application is a continuation of copending International Application No. PCT/DE01/00893 filed Mar. 8, 2001, which designates the United States, and claims priority to German application 10015268.6 filed Mar. 28, 2000.

DESCRIPTION

The invention relates to an injection valve for a common rail injection system.

BACKGROUND OF THE INVENTION

In the case of a common rail injection system, the fuel is injected into the combustion chamber of an internal combustion engine at a pressure of up to 2000 bar. The high fuel pressure requires precise control of the injection time and of the injection quantity. Furthermore, it is necessary, for internal combustion engines which are operated with diesel fuel, to carry out an exact pre-injection with a small quantity of fuel in order to minimize the noise of the internal combustion engine and also the emission of pollutants. For the abovementioned reasons, it is necessary to coordinate the injection valve very precisely, so that an optimum shaping of the injection profile is achieved.

The article "A Common Rail Injection System For High Speed Direct Injection Diesel Engines", SAE paper 980803, by N. Guerrassi et al. discloses a fuel injection valve for a common rail injection system which has a control chamber which is supplied with fuel by a fuel line via a inlet throttle. The control chamber is connected via a outlet throttle to a outlet line which can be connected to a fuel reservoir via an electromagnetic valve. Furthermore, a bypass throttle is provided which creates a connection between the fuel line and the outlet line. The control chamber is bounded by a nozzle needle which is arranged in an axially movable manner in a nozzle body. The nozzle needle is guided through a nozzle chamber which is connected to the fuel line. Furthermore, the nozzle needle has pressure surfaces which are acted upon by the fuel pressure prevailing in the nozzle chamber and apply force to the nozzle needle in the direction of the control chamber. A nozzle spring which prestresses the nozzle needle in the direction of its sealing seat is provided in the control chamber. The pressure in the pressure chamber is controlled as a function of the opening position of the electromagnetic valve. If the valve is opened, fuel flows out of the pressure chamber via the outlet throttle and at the same time less fuel flows in via the inlet throttle, so that the pressure in the control chamber drops. As a consequence of this, the nozzle needle is moved in the direction of the nozzle chamber, the nozzle needle lifting with its point off a sealing seat and releasing a connection between the fuel line and injection holes.

If the electromagnetic valve is now closed, then fuel flows into the control chamber via the inlet throttle, via the bypass throttle and the outlet throttle. In this manner, the pressure in the control chamber is rapidly increased, so that the nozzle needle is pressed relatively rapidly onto its sealing seat in the nozzle body and the injection is therefore rapidly ended.

The injection valve described has the disadvantage of the nozzle spring being situated in the control chamber and hence a relatively large control chamber being necessary, which constitutes a large harmful volume. Furthermore, the installation of the nozzle spring in the control chamber gives rise to the risk of, during installation, particles of dirt entering into the control chamber and collecting in the outlet throttle and impairing the functioning capability of the injection valve. Cavitation bubbles arising in the inlet throttle may damage the nozzle spring.

SUMMARY OF THE INVENTION

The object of the invention is to provide an injection valve with a simpler construction, in which the functioning of the hydraulic control system is not impaired.

The object of the invention is achieved by an injection valve comprising:

- a fuel line which is guided to a control chamber via a inlet throttle,
- a outlet throttle which connects a return line to the control chamber,
- a control valve which is connected in the return line upstream of a return flow,
- a bypass throttle which connects the fuel line to the return line,
- a nozzle needle which is arranged movably in a nozzle chamber, wherein the nozzle chamber being connected to the fuel line, the nozzle needle being connected to a control piston, the control piston bounding the control chamber, part of the return line is designed as a valve chamber, and the bypass throttle opens into the valve chamber.

A method of operating an injection valve comprises the steps of:

- storing fuel at high pressure in a fuel line;
- supplying the high pressured fuel to a valve chamber, to a control chamber for controlling a nozzle needle;
- controlling the pressure in the control chamber through a servo valve and an outlet throttle coupling the valve chamber and the control chamber.

Part of the return line is preferably designed as a valve chamber into which a bypass throttle opens. In this manner, a compact construction of the injection valve is achieved.

Further advantageous designs of the inventions are specified in the dependent claims. A chamber through which a connecting rod, which connects a control piston to the nozzle needle, is guided is preferably connected directly to the fuel line which conveys fuel under high pressure. In addition, a leakage line is not connected to the chamber. This largely avoids leakage via the chamber.

An advantageous construction of the injection valve is achieved by the control chamber being bounded by a control piston which is operatively connected to the nozzle needle via a rod. The rod is guided through a chamber in which a needle spring for prestressing the nozzle needle is arranged. In this manner, the control chamber is free from movable parts, so that contamination of the control chamber by components which have been placed in it is prevented. In addition, the control chamber can be of particularly small design, as a result of which the dead volume when activating the nozzle needle is reduced.

The cross section of the control piston is preferably designed to be equal to the cross section of the guided region of the nozzle needle. In this manner, just one guide has to be manufactured, as a result of which the injection valve is cost-effective.

A closing member which is prestressed against a sealing seat by a spring is placed in the valve chamber, said spring likewise being arranged in the valve chamber.

BRIEF DESCRIPTION OF THE DRAWING

The invention will be explained in greater detail below with reference to the FIGURE: The FIGURE shows the schematic construction of an injection valve for a common rail injection system.

DETAILED DESCRIPTION OF THE PREFERRED EMBODIMENT

The injection valve has a housing 29 which is connected to a fuel store 10 via a inlet line 30. The fuel store 10 is supplied with fuel, for example, by an adjustable high-pressure pump. The inlet line 30 is guided to a fuel line 11 in the housing 29. The fuel line 11 is connected to a nozzle chamber 20 which opens into an injection space 31 from which injection holes 22 emanate. The nozzle chamber 20 and the injection space 31 are placed in a nozzle body 39 which is situated at the lower tip of the injection valve. A second sealing seat 21 is arranged in the injection space 31 and, in the closed state, a nozzle needle 32 rests on it with a needle tip 19. The needle tip 19 is connected to a guide section 18 which is designed in the form of a cylinder.

The guide section 18 is guided in a longitudinally movable manner in a guide hole 33 of the injection valve. The guide hole 33 is made in the housing 29 in the form of a cylindrical recess. The guide hole 33 opens on one side into the nozzle chamber 20 and on the other side into a passage hole 34 which is likewise of cylindrical design and preferably has a smaller cross section than the guide hole 33. Grooves 40 which connect the nozzle chamber 20 to the chamber 25 are preferably provided. The passage hole 34 opens in turn into a chamber 25 which is likewise of cylindrical design and has a larger cross section than the guide hole 33. A coupling piece 35 which rests on the guide section 18 is arranged in the passage hole. A coupling rod 17 which rests with a plate 23 on the coupling piece 35 is arranged in the chamber 25. The plate 23 is of circular design and has a larger cross section than the cylindrical coupling piece 17. The plate 23 has the function of a supporting collar for the needle spring 24.

As an alternative to the grooves 40, the guide 18 for the nozzle needle may also be completely omitted, so that a circular hollow space between the nozzle needle 32 and housing 29 connects the nozzle chamber 20 to the chamber 25. Furthermore, the chamber 25 can also be connected directly to the high-pressure line 11 via a connecting line 26.

The chamber 25 opens on the side lying opposite the passage hole 34 into a second guide hole 36. The second guide hole 36 is likewise cylindrical. In the second guide hole 36, a cylindrical control piston 16 which is connected to the coupling rod 17 is arranged in a manner such that it can move in the longitudinal direction. A control chamber 15 is formed in the second guide hole 36, between the upper end of the control piston 16 and the housing 29.

Arranged in the chamber 25 is a needle spring 24 which comprises the coupling rod 17 and is arranged between the plate 23 and a step 37, the step 37 being arranged in the transition region between the chamber 25 and the second guide hole 36. The second guide hole 36 has a smaller diameter than the chamber 25. The functioning of the needle spring 24 consists in the needle spring 24 prestressing the nozzle needle 32 with the needle tip 19 onto the second sealing seat 21. The chamber 25 is preferably connected to the fuel line 11 via a connecting line 26.

The control chamber 15 is connected to the fuel line 11 via a inlet throttle 13 and to a valve chamber 9 via a outlet throttle 14. The cross section of the inlet throttle 13 is smaller than the cross section of the outlet throttle 14. A closing member 6 and a valve spring 8 are arranged in the valve chamber 9, the closing member 6 being prestressed by the valve spring 8 in the direction of a sealing seat 7. The closing member 6 and the sealing seat 7 constitute a servo valve 5. The valve chamber 9 is connected via a outlet hole 38 to a return flow 41. Furthermore, a bypass throttle 12 is provided in the form of a hole which connects the fuel line 11 to the valve chamber 9. The lines between the control chamber 15 and the servo valve 6 constitute the return line 27. A valve piston 4 which is connected to an actuator 3 is guided in the outlet hole 38. The valve piston 4 rests with a pressure surface on an associated pressure surface of the closing member 6. The actuator 3 is connected to a control unit 1 via electrical connections 2.

The injection valve functions as follows: Fuel at high pressure is situated in the fuel store 10, so that when a servo valve 5 is closed with the closing member 6 bearing against the sealing seat 7, fuel at high pressure is present in the valve chamber 9, in the control chamber 15, in the nozzle chamber 20, in the injection space 31 and in the chamber 25. Since the surface with which the control piston 16 borders onto the control chamber 15 is larger than the surface which the nozzle needle 32 acts upon with pressure in the direction of the control chamber 15 and, in addition, the prestressing force of the needle spring 24 presses the nozzle needle 32 onto the sealing seat 21, the nozzle needle 22 sits on the sealing seat 21 and separates the injection space 31 from the injection holes 22. An injection does not therefore take place.

If an injection is now to take place, the control unit 1 activates the piezoelectric actuator 3 to the effect that the actuator 3 is deflected and lifts the closing member 6 off the sealing seat 7 via the valve piston 4. As a consequence of this, more fuel flows out of the control chamber 15 via the outlet throttle 14 than flows in via the inlet throttle 13. The fuel flows via the outlet throttle 14 into the valve chamber 9 and continues via the outlet hole 38 into the return line 27 to a fuel reservoir. As a consequence of this, the pressure in the control chamber 15 drops. The pressure in the nozzle chamber 20 continues to remain at the level of the fuel line 11. As a consequence of this, the force which lifts the nozzle needle 32 off the second sealing seat 21 predominates, so that the nozzle needle 32 releases the second sealing seat 21 and opens a connection between the injection space 31 and the injection holes 22. Fuel is therefore discharged from the injection space 31 via the injection holes 22.

In this position, fuel also flows via the bypass throttle 12 into the valve chamber 9 and via the outlet hole 38 to the return line 27.

If the injection is now to be ended, the control unit 1 activates the piezoelectric actuator 3 to the effect that the actuator 3 is shortened. The closing member 6 is therefore pressed again by the valve spring 8 onto the sealing seat 7, so that the connection to the return line 27 is interrupted. Fuel continues to flow from the fuel line 11 via the bypass throttle 12 into the valve chamber 9 and from the valve chamber 9 via the outlet throttle 14 into the control chamber 15. At the same time, fuel flows from the fuel line 11 via the inlet throttle 13 into the control chamber 15. A high fuel pressure is therefore rapidly achieved again in the fuel chamber 15, so that the nozzle needle 32 is pressed again onto the second sealing seat 21 by the pressure which prevails in the control chamber 15. Consequently, the connection between the injection space 31 and the injection holes 22 is interrupted.

By means of the connection of the chamber 25 to the pressure of the fuel line 11 via the connecting line 26 or the grooves 40, a hydraulic connection of the chamber 25 is achieved. As a result, a movement of the nozzle needle 32 which is particularly low in friction is possible. In addition, a leakage via the chamber 25 in the direction of the control chamber 15 only occurs if the servo valve 5 is opened and small pressure prevails in the control chamber 15. Furthermore, the connection of the chamber 25 to the fuel line 11 has the advantage that the fit between the guide section 18 and the guide hole 33 does not have to be so precise, since no seal is necessary between the nozzle chamber 20 and the chamber 25. This enables a saving on costs during the production of the injection valve.

Furthermore, the fit between the control piston 16 and the second guide hole has to be manufactured very precisely in order to ensure a seal between the control chamber 15 and the chamber 25.

One aim of the application is to avoid permanent leakage. For this purpose, the chamber 25 which contains the needle spring is connected along the nozzle-needle guide to the high pressure in the nozzle chamber. The single, hydraulically effective piston surface which controls the movement of the nozzle needle is therefore the cross section of the control-piston guide. When the needle is open and the servo valve is closed, the compressive forces acting on the connection of the needle and control piston are virtually equalized. The closing process is essentially introduced by the needle spring. The bypass throttle is arranged in order not to obtain too great an invasion of pressure in the control space by the downwardly directed closing movement of needle and control piston. The bypass throttle is without significance for the opening of the nozzle needle if it is of small enough design in order not to impair the reduction in pressure via the servo valve 5. During the closing process, it is used as an additional inlet throttle with which the control chamber can be filled via the outlet throttle. The combination of a single, hydraulically active guide of the needle in order to avoid permanent leakage, on the one hand, and of the bypass throttle in order to improve the function, on the other hand, gives rise to the following advantages:

- no permanent leakage outside the switching process/injection process of the injection valve, since the chamber is under high pressure;
- retention of a separate chamber for the needle spring, as a result of which a small control-space volume, i.e. small harmful space is achieved;
- avoidance of soiling problems on the servo valve or of cavitation damage on the spring;
- inclusion of the chamber 25 in the high-pressure volume of the nozzle chamber, as a result of which an enlargement of the high-pressure volume upstream of the nozzle is achieved;
- reduction in the invasion of pressure as a consequence of the compressibility of diesel oil in the high-pressure line after opening;
- improvement of the atomization of the diesel fuel in the injection holes after opening, since more pressure is available;
- only one guide of the nozzle needle has to be precisely manufactured;
- use of a bypass throttle for assisting the closing process of the nozzle needle;
- inclusion of the high-pressure chamber, which contains the servo valve and the valve needle, in the design of the bypass throttle.

Owing to the manner of operation of the piezo actuator, it is advantageous to use a servo valve operating inwards (counter to the high pressure). The chamber which arises can be used as a outlet line in order to connect the high-pressure line via the bypass throttle to the outflow of the outlet throttle.

What is claimed is:

1. An injection valve comprising:

a fuel line which is guided to a control chamber via a inlet throttle, an outlet throttle which connects a return line to the control chamber, a control valve which is connected in the return line upstream of a return flow, a bypass throttle which connects the fuel line to the return line, a nozzle needle which is arranged movably in a nozzle chamber, wherein the nozzle chamber being connected to the fuel line, the nozzle needle being connected to a control piston, the control piston bounding the control chamber, part of the return line is designed as a valve chamber, and the bypass throttle opens into the valve chamber.

2. The injection valve as claimed in claim 1, wherein the control piston is connected to the nozzle needle via a rod, and in that the rod is guided through a chamber.

3. The injection valve as claimed in claim 2, wherein the chamber is connected to the fuel line.

4. The injection valve as claimed in claim 1, wherein the cross section of the control piston is equal to the cross section of the guided region of the nozzle needle.

5. The injection valve as claimed in claim 1, wherein a closing member which is pre-stressed against a sealing seat by a spring is arranged in the valve chamber.

6. The injection valve as claimed in claim 2, wherein grooves are provided which connect the nozzle chamber to the chamber.

7. The injection valve as claimed in claim 2, wherein a spring which pre-stresses the nozzle needle in the direction of a sealing seat is arranged in the chamber.

8. The injection valve as claimed in claim 1, wherein the control valve is comprises a piezo electric actuator.

* * * * *